US005658154A

United States Patent [19]

Bumsted et al.

[11] Patent Number: 5,658,154

[45] Date of Patent: Aug. 19, 1997

[54] PRINTED CIRCUIT BOARD MOUNTED ELECTRICAL CONNECTOR

[75] Inventors: Thomas C. Bumsted, Elgin; Michael O'Sullivan, Willowbrook; David R. Schmidgall, Streamwood; James A. Wetter, Hoffman Estates, all of Ill.

[73] Assignee: Molex Incorporated, Lisle, Ill.

[21] Appl. No.: 485,559

[22] Filed: Jun. 7, 1995

[51] Int. Cl.[6] ..... H01R 9/09

[52] U.S. Cl. ..... 439/79; 439/532; 439/937

[58] Field of Search ..... 439/79, 80, 83, 439/532, 590, 874, 876, 937

[56] References Cited

U.S. PATENT DOCUMENTS

| | | | |
|---|---|---|---|
| D. 314,179 | 1/1991 | Ogawa . | |
| 4,047,781 | 9/1977 | DeNigris et al. . | |
| 4,655,517 | 4/1987 | Bryce | 439/937 X |
| 4,787,866 | 11/1988 | Morningstar et al. . | |
| 5,145,411 | 9/1992 | Pastal et al. . | |
| 5,161,997 | 11/1992 | Defibaugh et al. . | |
| 5,161,998 | 11/1992 | Defibaugh et al. . | |
| 5,184,961 | 2/1993 | Ramirez et al. | 439/532 X |
| 5,234,353 | 8/1993 | Scholz et al. . | |
| 5,238,413 | 8/1993 | McCaffrey et al. . | |
| 5,281,165 | 1/1994 | McCleerey et al. . | |
| 5,288,246 | 2/1994 | Whiteman, Jr. et al. . | |
| 5,314,357 | 5/1994 | Weidler . | |

OTHER PUBLICATIONS

Molex Drawing No. 70983-0001, Dated Jan. 11, 1991, Sheet 1 of 2 Entitled: "Female Housing LFH .050" Pitch, 60ckt.

Molex Drawing No. 70986-****, Dated Feb. 5, 1993, Sheet 1 of 2 Entitled: "Tail Aligner .050" Pitch LFH 60ckt Plug.

Moelx Drawing Dated May 15, 1991.

*Primary Examiner*—Jes F. Pascua

*Attorney, Agent, or Firm*—Charles S. Cohen

[57] ABSTRACT

An electrical connector is mountable to a substrate such as a printed circuit board. The connector includes a molded dielectric housing having terminals mounted through an elongated body portion of the housing. The terminals have tails projecting rearwardly of the body portion. A plurality of discrete mating portions are spaced along the body portion and project forwardly of a front face thereof. A recessed area is formed in the front face of the body portion between adjacent forwardly projecting mating portions. A rib projects rearwardly of the body portion between the tails of the terminals for adjacent mating portions. The recessed areas form flow interrupters for molten material of which the housing is molded.

17 Claims, 2 Drawing Sheets

PRINTED CIRCUIT BOARD MOUNTED ELECTRICAL CONNECTOR

FIELD OF THE INVENTION

This invention generally relates to the art of electrical connectors and, particularly, to a system for facilitating molding of a connector housing.

BACKGROUND OF THE INVENTION

Generally, a typical electrical connector includes some form of dielectric or insulative housing which mounts a plurality of conductive terminals. The terminals have contact portions which are engageable by the contacts of a complementary mating connector or other connecting device.

A wide variety of electrical connectors are designed for mounting to a printed circuit board. Such connectors conventionally include a dielectric housing, such as a unitarily molded plastic housing, adapted for mounting to one side of the board. The housing typically includes a front mating face for mating with the complementary connecting device and a terminating face from which tail portions of a plurality of terminals exit the housing for termination to circuit traces on the printed circuit board. The terminals normally include mating portions for mating with the terminals or contacts of the complementary connecting device, and the tail portions projecting from the rear of the housing are interconnected, as by soldering, to circuit traces on the board and/or in holes in the board into which the tails are inserted.

In one type of printed circuit board mounted electrical connector, the housing includes an elongated body portion, with one or more mating portions of the housing projecting forwardly of a front face of the body portion. The terminal tails and, possibly, mounting portions of the housing project from a rear face of the body portion. Some printed circuit board mounted electrical connectors are designed for mounting at an edge of the board. The connector housing typically engages the edge and has a mounting portion for mounting to a top surface of the board. For instance, the aforementioned elongated body portion of the connector housing may run along the edge of the board, with the mating portions of the housing projecting freely away from but generally parallel to the board.

One of the problems with elongated electrical connectors of the character described above is that the elongated body portion of the dielectric connector housing has a tendency to bow or warp during fabrication thereof. In particular, the housing, including the elongated body portions thereof, typically is unitarily molded of some type of plastic material, such as LCP or the like. This problem is particularly critical with surface mounted electric connectors wherein the terminal tails should be maintained in a common plane for surface connection to the circuit traces on the top surface of the printed circuit board. If the molded plastic housing has a bow or warp, some of the tail portions may be spaced from their respective circuit traces on the board which, in turn, can result in defective or totally incomplete connections between the terminal tails and the circuit traces during permanent processing of the connector onto the board.

The present invention is directed to solving the above problems and providing an electrical connector which has a housing configuration that facilitates molding the housing without bowing or warping thereof.

SUMMARY OF THE INVENTION

An object, therefore, of the invention is to provide a new and improved printed circuit board mounted electrical connector of the character described.

In the exemplary embodiment of the invention, the connector includes a molded dielectric housing having terminals therein. The housing is adapted for mounting on a surface of the printed circuit board, with the terminals establishing electrical connection to appropriate circuitry on the board. The housing includes an elongated body portion extending between opposite ends of the housing. A plurality of discrete mating portions are spaced along the body portion and project forwardly of a front face thereof. A recess is formed in the front face of the body portion between adjacent mating portions. Each recess defines a pair of generally parallel flanges or rails extending longitudinally of the body portion between the opposite ends of the housing. The parallel flanges are continuous between opposite ends of the housing and provide continuous flow passages for the molten dielectric material of which the connector housing is fabricated. The recesses form flow interrupters which restrict flow of the molten material at the center of the elongated body to proper filling of the mating portions without significantly affecting the flow through the passages which define the parallel flanges. This is especially important when molding the housing of a glass filled polymer having glass fibers in order to maintain the fibers in an orientation generally parallel to the elongated housing which will prevent bowing or warping of the connector housing.

The terminals are mounted on the elongated body portion and project into each spaced mating portion and have tails projecting rearwardly of the body portion. Another feature of the invention is the provision of a boss projecting rearwardly of the elongated body portion between the tail portions of the terminals for adjacent mating portions.

Preferably, the housing, including the body portion, the forwardly projecting mating portions and the rearwardly projecting bosses, is a one-piece structure of molded dielectric material. One of the recesses and one of the bosses may be provided between each end of the housing and the adjacent one end of the plurality of mating portions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 2, 6:
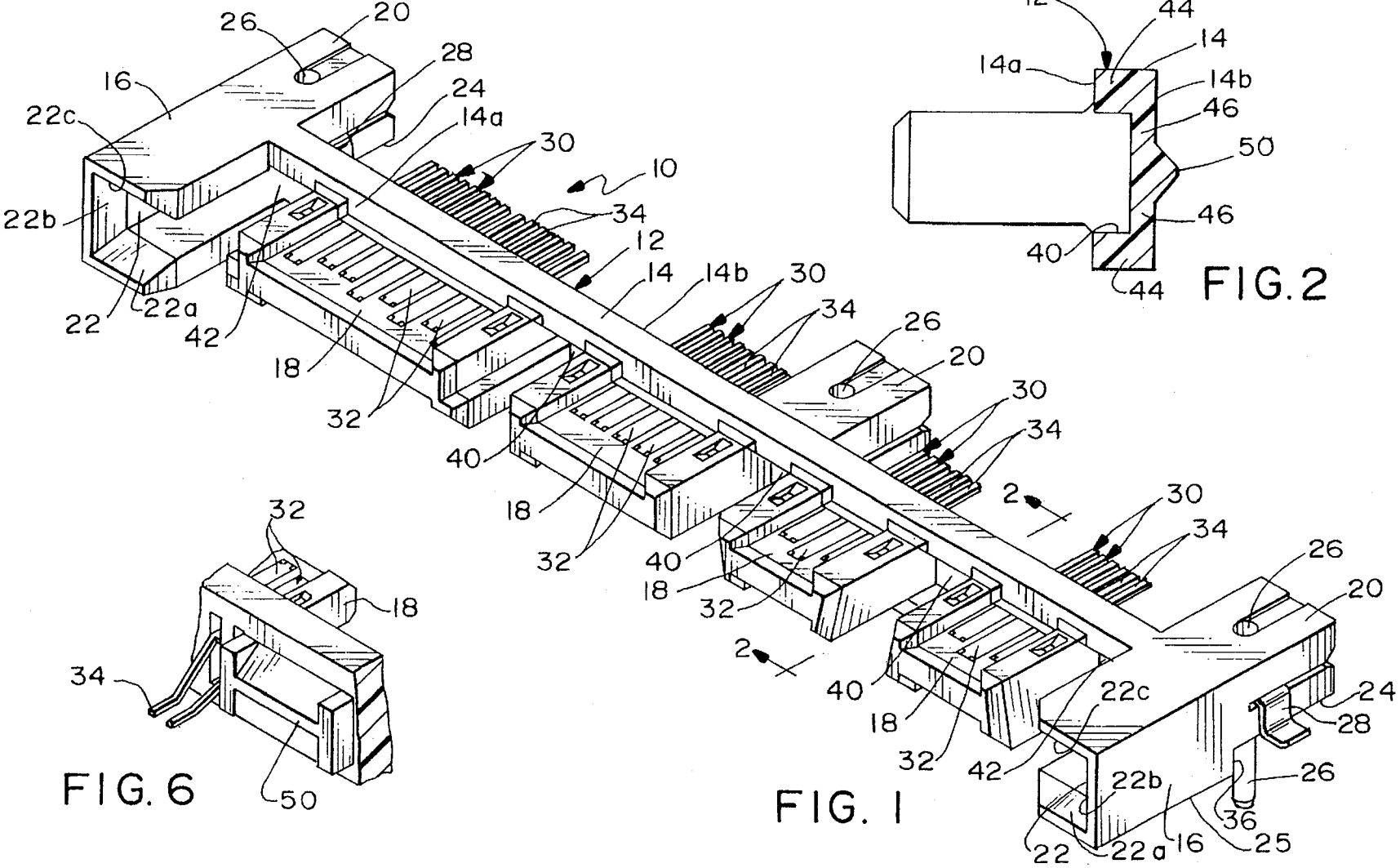
FIG. 1 is a perspective view of an electrical connector embodying the concepts of the invention.
FIG. 2 is a vertical section, on an enlarged scale, taken generally along line 2—2 of FIG. 1.
FIG. 6 is an enlarged fragmented rear perspective view of a portion of the housing showing one of the bosses projecting from the rear of the housing.

Referring to the drawings in greater detail, the invention is embodied in an electrical connector, generally designated 10, which is adapted for mounting to a substrate such as a printed circuit board. In particular, the connector is adapted for mounting at an edge of the circuit board, as will be seen hereinafter.

Connector 10 includes a one-piece housing, generally designated 12, unitarily molded of dielectric material such as plastic or the like. The housing includes an elongated body portion 14 extending between opposite ends 16, with a plurality of discrete mating portions 18 projecting forwardly from a front face 14*a* of body portion 14, and a plurality of mounting portions 20 projecting rearwardly of the body portion.

Ends 16 of housing 12 include inwardly facing channels 22 for receiving therebetween a complementary connector (not shown) which includes receptacle means for receiving mating portions 18. Such inwardly facing channels include lead-in surfaces 22*a*, 22*b* and 22*c* on three sides for guiding the complementary connector during mating. Rearwardly projecting mounting portions 20 of housing 12 include a lower surface 24 located above the bottom surface 25 of ends 16 for positioning on a top surface of the printed circuit board. Locating pins 26 may extend through the mating portion for locating the connector in appropriate locating holes in the printed circuit board. Hold-down clips 28 may be mounted on the mounting portions for surface connection to solder pads on the top surface of the printed circuit board.

Figures 3, 4, 5:
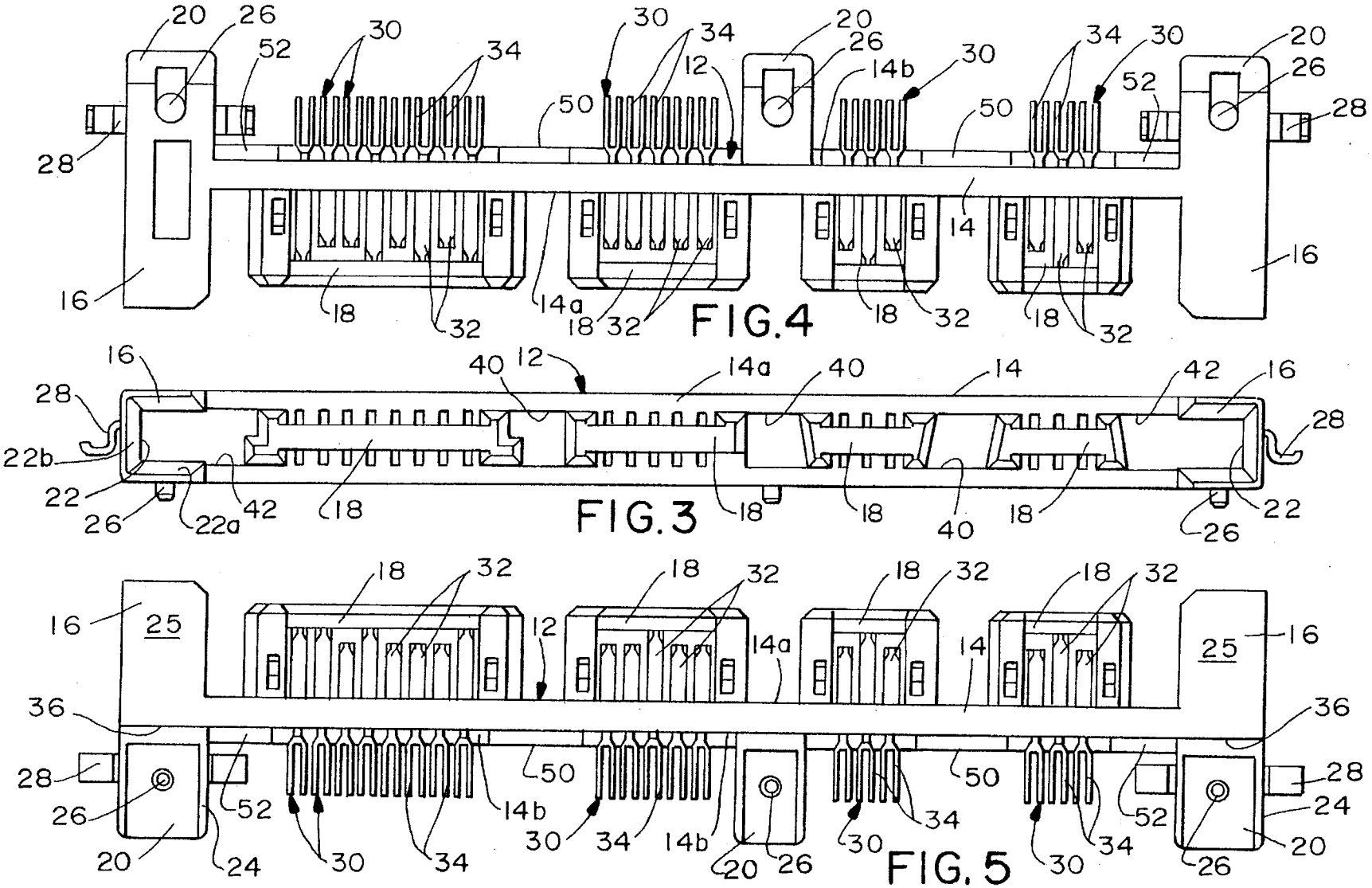
FIG. 3 is a front elevational view of the connector.
FIG. 4 is a top plan view of the connector.
FIG. 5 is a bottom plan view of the connector.

A plurality of terminals, generally designated 30, are mounted in connector housing 12. The terminals include contact ends 32 disposed in mating portions 18 and tail portions 34 projecting from a rear face 14*b* of body portion 14 for surface connection to circuit pads leading to traces on the printed circuit board. Rear face 14*b* of body portion 14 and rearwardly facing surfaces 36 beneath mounting portions 20 define a continuous surface as seen in FIG. 5 for mounting connector 10 along an edge of the printed circuit board. As can be seen in the Figures, the terminals extend through body portion 14 with the contact ends 32 located on one side and tail portions 34 on the other side. In addition, the terminals are configured so that the tail portions 34 are aligned in a generally planar row while the contact ends are aligned in two rows, one on each side of the mating portions 18.

As best seen in FIGS. 1–3, recessed areas 40 are formed in front face 14*a* of body portion 14 between adjacent forwardly projecting mating portions 18. In addition, recessed areas 42 (FIG. 3) may be formed between each end 16 of housing 12 and its adjacent forwardly projecting mating portion 18. These recesses are formed as cored-out areas during molding of the one-piece housing.

As best seen in FIGS. 1 and 2, body portion 14 includes a pair of generally parallel, rectangularly shaped rails or flanges 44 extending longitudinally relative to the housing 12 and defining the upper and lower (as viewed in FIGS. 1 and 2) portions of the body. The mating projections 18 and recessed areas 40 and 42 are vertically positioned between these rails 44. During molding, the recessed areas 40 and 42 facilitate the molten plastic material properly filling the mating projections 18.

Relatively thin walls 46 connect the rails 44 at the recessed areas 40 and 42. As can be seen in FIG. 2, the leading surface of walls 46 is located slightly behind the centerline of the body 14. The location of the leading edge depends upon the dimensions of the housing, the material used as well as the variables commonly encountered in molding plastic such as temperature, flow rate and pressure.

More particularly, it is anticipated that the connector housing 12 will be molded of a glass-filled polymer such as LCP, PBT or PCT. These plastic materials have a significant amount of glass fiber filler, and depending upon the shape of the housing to be molded, the orientation of the glass fiber may be important. For example, with the present design, if the glass fiber were significantly curved in the rails 44, the rails and thus the housing 12 would be likely to bow.

During molding, the portion of the mold for forming the recessed areas 40 and 42 tends to force molten plastic into the portion of the mold for forming the mating projections 18. This helps to evenly fill the mold including the portions for forming the mating projections without any or with a minimal amount of backfilling. The plastic flows through rails 44 with the glass fibers generally longitudinally oriented in the elongated direction of the connector housing even while filling the mating projections.

As best seen in FIGS. 4–6, generally triangular ribs 50 project rearwardly from the elongated body portion 14. One rib is aligned with each of the recessed areas 40 and 42 except for the center recess with which a mounting portion 20 is aligned. The primary function of these ribs 50 is to strengthen and stiffen the walls 46 to prevent bending or breaking thereof. In addition, such ribs may also function in a similar manner to recessed areas 40 and 42 to redirect the flow of plastic into mating portions 18.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An symmetrical electrical connector mountable to a substrate such as a printed circuit board, comprising:

a molded dielectric one-piece housing being adapted for mounting on a surface of the circuit board with the terminals establishing electrical connection to appropriate circuit members on the board, and the housing including an elongated body portion extending between opposite ends of the housing, a plurality of discrete mating portions spaced along the body portion and projecting forwardly of a front face thereof and dimensioned for mating with a receptacle of an appropriate mating connector, said mating portions including oppositely facing upper and lower surfaces and including a plurality of terminal receiving recesses therein, and a recess in the front face of the body portion between adjacent mating portions to define a pair of generally parallel, continuous rails extending longitudinally of the body portion between the adjacent mating portions, whereby said mating portions are interconnected by said pair of rails and a relatively thin wall between said rails; and a plurality of conductive terminals mounted within said housing, a portion Of each terminal extending through said body portion of said housing and a contact end of each terminal being located within one of said terminal receiving recesses whereby a contact portion of each terminal extends along one of said upper and lower surfaces of said mating portions.

2. The electrical connector of claim 1, including one of said recesses between each end of the housing and the adjacent end-most one of said plurality of forwardly projecting mating portions.

3. The electrical connector of claim 1 wherein said terminals include tail portions projecting rearwardly of the body portion, and said housing includes a rib projecting rearwardly of the elongated body portion and generally aligned with each said recess.

4. The electrical connector of claim 3, including one of said ribs between each end of the housing and the tail portions of the terminals for the adjacent end-most one of said plurality of mating portions.

5. The electrical connector of claim 4 wherein said ribs have a generally triangular cross-section.

6. An asymmetrical electrical connector mountable on a printed circuit board, comprising:

a unitarily molded, one-piece dielectric housing having an elongated body portion and a plurality of mating portions projecting forwardly of a front face of the body portion, said mating portions being generally elongated and extending a substantial distance from said body portion; and a plurality of terminals mounted within said housing, a portion of each terminal extending through said body portion of said housing and a contact end of each terminal being located within one of said mating portions; and a recessed area in the front face of the body portion between adjacent forwardly projecting mating portions.

7. An electrical connector as set forth in claim 6, wherein said housing includes opposite ends and one of said recessed areas between each end of the housing and an adjacent end-most one of said plurality of forwardly projecting mating portions.

8. An electrical connector as set forth in claim 6, wherein said terminals include tail portions projecting rearwardly of the body portion in an array for each mating portion, and including a rib projecting rearwardly of the elongated body portion between the arrays of tail portions for adjacent mating portions.

9. An electrical connector as set forth in claim 8, wherein said housing includes opposite ends and one of said ribs is positioned between each end of the housing and the tail portions of the terminals for an adjacent end-most one of said plurality of mating portions.

10. An electrical connector as set forth in claim 8 wherein said housing, including said body portion, said forwardly projecting mating portions and said rearwardly projecting bosses, is a one-piece structure of molded dielectric material.

11. An electrical connector as set forth in claim 10, wherein said body portion includes a rear surface for mounting along an edge of the printed circuit board, said recessed areas being located forwardly of said surface, and said ribs projecting rearwardly of said surface.

12. An electrical connector comprising:

a unitarily molded, one piece dielectric housing adapted for mounting on a surface of a substrate such as a printed circuit board, the housing having an elongated body portion and a plurality of mating portions projecting forwardly of a front face of the body portion and dimensioned for mating with a receptacle of an appropriate mating connector, said mating portions including oppositely facing upper and lower surfaces and including a plurality of terminal receiving recesses therein, and a plurality of terminals mounted within said housing, a portion of each terminal extending through said body portion of said housing and a contact end of each terminal being located within one of said terminal receiving recesses whereby a contact portion of each terminal extends along one of said upper and lower surfaces of said mating portions, the terminals including tail portions projecting rearwardly of the body portion of the housing, and a rib projecting rearwardly of the elongated body portion between the tail portions of the terminals for adjacent mating portions.

13. An electrical connector as set forth in claim 12, wherein said housing includes opposite ends and one of said ribs is positioned between each end of the housing and the tail portions of the terminals for an adjacent end-most one of said plurality of mating portions.

14. An electrical connector comprising:

a unitarily molded, one-piece dielectric housing having an elongated body portion and at least three mating portions projecting forwardly of a front face of the body portion, said mating portions being generally elongated and extending a substantial distance from said body portion; and a plurality of terminals mounted within said housing, each terminal including a contact end, a body and a tail portion, said body of each terminal extending through said body portion of said housing, said contact end of each terminal being located within one of said mating portions, and said tail portion of each terminal projecting rearwardly of the body portion of the housing to define an array of tail portions for each housing mating portion, and said housing further including a plurality of ribs projecting rearwardly of the elongated body portion of said housing, each rib being positioned between a pair of the arrays of tail portions for adjacent housing mating portions.

15. An electrical connector as set forth in claim 14, wherein said housing includes a recessed area in the front face of the body portion between each adjacent pair of forwardly projecting mating portions, said housing further having opposite ends and additional ones of said recessed areas are positioned between each end of the housing and an adjacent end-most one of said at least three forwardly projecting mating portions.

16. An electrical connector as set forth in claim 14, wherein said housing includes opposite ends and additional ones of said ribs are positioned between each end of the housing and the tail portions of the terminals for an adjacent end-most one of said at least three housing mating portions.

17. An electrical connector as set forth in claim 14, wherein said body portion includes a rear surface for mounting along an edge of the printed circuit board, said recessed areas being located forwardly of said surface, and said ribs projecting rearwardly of said surface.

* * * * *